US005827379A

United States Patent [19]

Okamura et al.

[11] Patent Number: 5,827,379

[45] Date of Patent: Oct. 27, 1998

[54] PROCESS FOR PRODUCING EXTRA HIGH TENSILE STEEL HAVING EXCELLENT STRESS CORROSION CRACKING RESISTANCE

[75] Inventors: Yoshihiro Okamura; Ryota Yamaba, both of Tokai; Tomoya Koseki, Chiba; Ichiro Nakagawa, Kurashiki, all of Japan

[73] Assignees: Nippon Steel Corporation, Tokyo; Kawasaki Steel Corporation, Hyogo, both of Japan

[21] Appl. No.: 785,717

[22] Filed: Jan. 17, 1997

Related U.S. Application Data

[63] Continuation of Ser. No. 462,409, Jun. 5, 1995, abandoned, which is a continuation of Ser. No. 143,795, Oct. 27, 1993, abandoned.

[51] Int. Cl.[6] ..... C21D 6/00

[52] U.S. Cl. ..... 148/621; 148/653; 148/654

[58] Field of Search ..... 148/621, 653, 148/654

[56] References Cited

U.S. PATENT DOCUMENTS

| | | | |
|---|---|---|---|
| 3,619,302 | 11/1971 | Aoki et al. | 148/621 |
| 4,814,141 | 3/1989 | Imani et al. | 420/109 |
| 4,826,543 | 5/1989 | Yano et al. | 148/653 |
| 4,946,516 | 8/1990 | Yano et al. | 148/653 |

FOREIGN PATENT DOCUMENTS

| | | | |
|---|---|---|---|
| 2307879 | 11/1976 | France . | |
| 56-9358 | 1/1981 | Japan . | |
| 56-33425 | 4/1981 | Japan | 148/653 |
| 57-188655 | 11/1982 | Japan . | |
| 58-91123 | 5/1983 | Japan . | |
| 60-46318 | 3/1985 | Japan | 148/653 |
| 61-130462 | 6/1986 | Japan . | |
| 61-272316 | 12/1986 | Japan . | |
| 1-230713 | 9/1989 | Japan . | |
| 2167441 | 5/1986 | United Kingdom . | |
| 2245282 | 1/1992 | United Kingdom . | |

OTHER PUBLICATIONS

Patent Abstract of Japan, vol. 16, No. 63 (C–911) Feb., 1992 JP32–60012 Nov. 20, 1991.

European Search Report EP 93 11 7410.6 Apr. 27, 1994.

*Primary Examiner*—Sikyin Ip
*Attorney, Agent, or Firm*—Kenyon & Kenyon

[57] ABSTRACT

An extra high tensile steel having an excellent stress corrosion cracking resistance in sea water and a yield strength of 1080 MPa or more is provided. A slab comprising, in terms of % by weight, 0.04 to 0.09% of C, 0.01 to 0.10% of Si, 0.05 to 0.65% of Mn, 8.0 to 11.0% of Ni, 0.5 to 1.5% of Mo, 0.2 to 1.5% of Cr, 0.02 to 0.20% of V and 0.01 to 0.08% of Al with the balance consisting of iron and unavoidable impurities is heated to a temperature between 1000° C. and 1250° C., hot rolled at a temperature of Ar' point or above, air-cooled, reheated at a rate of 120° C./min or less to a temperature region of from ($A_{C3}$ point—40° C.) to ($A_{C3}$ point+40° C.), quenched and subsequently tempered at a temperature of the $A_{C1}$ point or below.

2 Claims, 5 Drawing Sheets

PROCESS FOR PRODUCING EXTRA HIGH TENSILE STEEL HAVING EXCELLENT STRESS CORROSION CRACKING RESISTANCE

This application is a continuation, of application Ser. No. 08,462,409 filed Jun. 5, 1995, now abandoned, which is a continuation of application Ser. No. 08/143,795 filed Oct. 27, 1993 (now abandoned).

BACKGROUND OF THE INVENTION

1. Field of the Invention

The present invention relates to a process for producing an extra-high-tensile and high-toughness steel having a yield strength of 1080 MPa or more that has a high strength despite a low carbon content and is excellent in stress corrosion resistance in a stress corrosive environment, such as sea water and salt water.

2. Description of the Prior Art

In recent years, geophysical exploration on an earth scale, such as search and drilling for energy resources and occurrence of earthquake, has lead to a growing interest in ocean development in deep sea and activated the construction and installation of various containers for deep-sea use and the development of research ships for deep-sea use.

When various containers are used in a deep-sea environment, since a very high pressure is applied thereto, it is required for materials for these containers to have a high degree of toughness and strength from the viewpoint of structure.

In order to cope with the demand for safe, reliable, high-strength and high-toughness materials, the development of a Ni-containing low alloy steel and an improvement in the quality thereof have been effected in the art. For example, proposals have been made on many production processes, such as a process for producing a high-strength and high-toughness steel comprising Ni-Cr-Mo-V with $C+\frac{1}{8}Mo+V>0.26$ $Cr\leqq 0.8$ Mo as disclosed in Japanese Unexamined Patent Publication (Kokai) No. 56-9358, a process for producing a Ni-Cr-Mo-V-based extra high tensile steel as disclosed in Japanese Unexamined Patent Publication (Kokai) No. 57-188655, which enables a high strength and a high toughness to be provided in a wide cooling race range in a quenching treatment, and a process for a Ni-containing steel product, wherein very low P and very low S treatments are effected for the purpose of ensuring a high toughness. Although these processes are effective for increasing strength of toughness, there is a possibility that the reliability of the steel products produced by the above processes is poor in the environment contemplated in the present invention. Specifically, since the containers used in deep sea are exposed to sea water, the steel products should have a satisfactory resistance to corrosion in sea water, that is, a high resistance to stress corrosion cracking in sea water.

Examples of extra high tensile steel products having a high reliability underwater include a Ni-Cr-Mo-V-based high toughness and extra-high-tensile steel proposed in Japanese Examined Patent Publication (KoKoku) No. 64-11105, characterized by comprising a Ni-containing steel having lowered N and O contents and capable of satisfying a requirement of $Al(\%)\times N(\%)\times 10^4<1.5$, which high-toughness and extra-high-tensile steel has a significant effect. In this steel, however, the stress corrosion cracking resistance at the welding heat affected zone in sea water is inferior or that in the air as compared with the base material, which requires further study regarding improvement in safety and reliability. On the other hand, Japanese Examined Patent Publication (Kokoku) No. 1-51526 propose a process for producing an extra high tensile steel having an excellent stress corrosion cracking resistance, which comprises subjecting a Ni-Mo-Nb-based steel having a Ni content of 5 to 8% to direct quenching-and-tempering. The strength of the steel product, however, is lower than that contemplated in the present invention. In the production of a thick high tensile steel by the direct quenching-and-tempering process, close control is necessary from the viewpoint of the homogeneity and anisotropy of the quality in the direction of the plate thickness. Further, there is a possibility that the stability of the quality if deteriorated in the widthwise direction and longitudinal direction within the steel plate.

Thus, the conventional extra high tensile steel products have lower stress corrosion cracking resistance particularly at the welding-heat affected zone in sea water than in the air and are produced by processes that are disadvantageous in the homogeneity of the quality in the thicknesswise direction of the thick steel plate and the stability of the quality within the steel plate. That is, a further improvement in both the steel products and production processes has been desired in the art.

SUMMARY OF THE INVENTION

An object of the present invention is to improve the homogeneity of the quality of a thick steel product through an alleviation in the problem of the prior art, i.e., a problem of the stress corrosion cracking resistance, particularly a deterioration in the stress corrosion cracking resistance at the welding heat affected zone in sea water, together with an increase in the tensile strength. The subject matter of the present invention is as follows.

A process for producing an extra high tensile steel having an excellent stress corrosion cracking resistance, comprises the steps of: heating a slab comprising, in terms of % by weight, 0.4 to 0.9% of C, 0.01 to 0.10% of Si, 0.5 to 0.65% of Mn, 8.0 to 11.0% of Ni, 0.5 to 1.5% of Mo, 0.2 to 1.5% of Cr, 0.2 to 0.20% of V and 0.1 to 0.08% of Al with the balance consisting of iron and unavoidable impurities or a slab comprising the above-descried ingredients and further comprising at least one member selected from the group consisting of 0.02 to 1.5% of Cu, 0.005 to 0.10% of Nb and 0.005 to 0.03% of Ti as strength improving elements and 0.005 to 0.005% of Ca and 0.0005 to 0.0100% of REM (Rare earth metal) as elements having a capability or regulating the form of inclusions to a temperature between 1000° C. and 1250° C., hot-rolling the slab at a temperature of $Ar^V$ point (the term "Ar"point'" being used because, in the steel of the present invention, ferrite is not formed from the authentic state even at the Ar3 transformation point and there occurs $\gamma\rightarrow\gamma'$), or above, air-cooling the rolled plate, reheating the rolled plate at a rate of 120° C./min or less to a temperature region of from ($A_{C3}$ point−40° C.,) to ($A_{C3}$ point+40° C.), quenching the reheated plate and subsequently tempering the quenched plate at a temperature of the $A_{C1}$ point or below.

Figure 4:
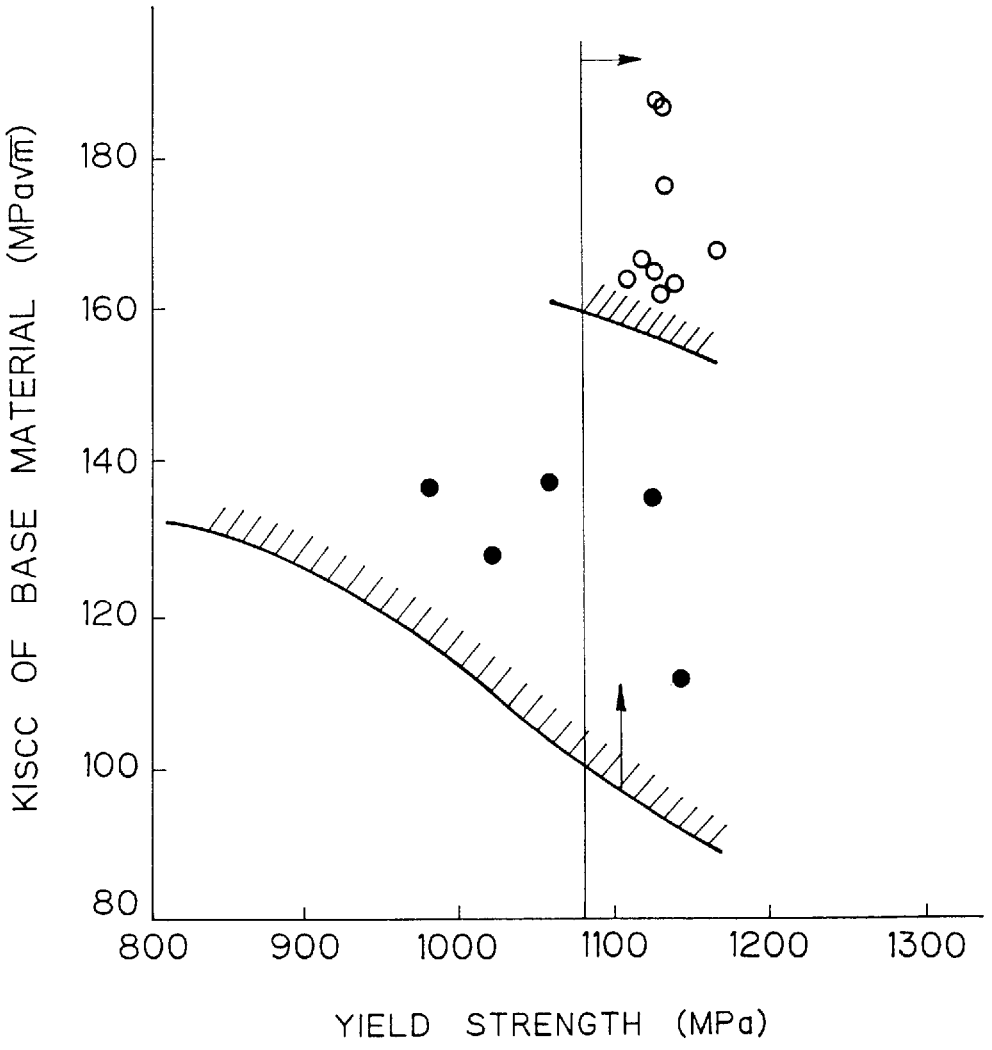
Figure 5:
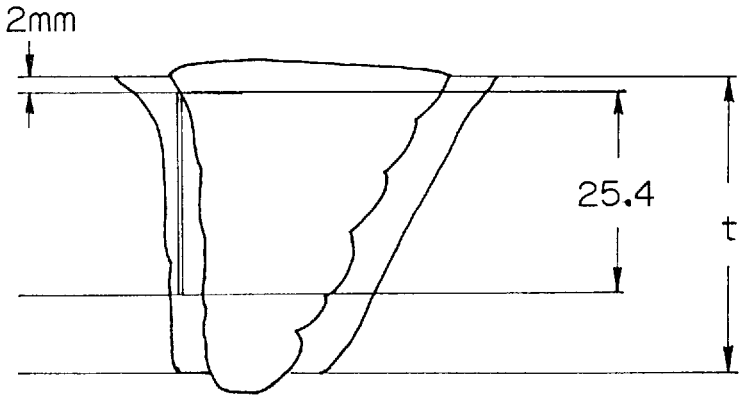

is a metallic microstructure for a reheating temperature region of ($A_{C3}$ point−40° C.) of below, (B) is a metallic microstructure for a reheating temperature region falling within the scope of the present invention and (C) is a metallic microstructure for a reheating temperature region of ($A_{C3}$ point+40° C.) or above);

FIG. 4 is a diagram showing the relationship between the yield strength and the $K_{1SCC}$ value of the base material of an example of the present invention; and FIG. 5 is a diagram showing a notch position for the evalation of $K_{1SCC}$ value in the welding-heat affected zone in an example of the present invention;

DESCRIPTION OF THE PREFERRED EMBODIMENTS

The present inventors have conducted various studies on steel ingredients and production process, particularly on hot rolling, reheating, quenching and tempering with a view to stably producing a Ni-containing low alloy steel having a good resistance to a stress corrosion cracking, particularly stress corrosion cracking at the welding-heat effected zone, in sea water or sea water and, at the same time, a high tensile strength and a high toughness and, as a result, have found that, when Mo, V and Nb are added to a Ni-containing steel having lowered C, Si and Mn contents and the Ni-containing steel is not rolled to sufficiently dissolve these elements in a solid solution form and reheated and quenched with controlled temperature rise rate and heating temperature range, the Mo, V and Nb dissolved in a solid solution form are precipitated during heating to form non-diffusion type reverse transformed γ grains comprising a group of acicular austenites having a high dislocation density, which enables a reinforcing mechanism inherent in the Ni-containing steel to be exhibited to attain an increase in the strength.

At the outset, the reason for the limitation of ingredients of the steel according to the present invention will now be described.

C is an element useful for improving the quenchability and easily increasing the strength. On the other hand, it has the greatest effect on an improvement in the stress corrosion cracking resistance of the welding-heat affected zone of the extra high tensile, steel. When the content exceeds 0.09%, a significant lowering in the stress corrosion cracking resistance of the welding-heat affected zone occurs. On the other hand, when it is lower than 0.04%, the strength is unsatisfactory. For this reason, the C content is limited to 0.04 to 0.09%.

Si is useful for improving the strength. It is also indispensable for steel making. Si is contained in an amount of 0.1% at the smallest. In the case of a high Ni-containing steel contemplated in the present invention, then the Si content exceeds 0.10%, the temper brittleness becomes so great that the low-temperature toughness is lowered. For this reason, the Si content is limited to 0.01 to 0.10%.

Figure 1A:
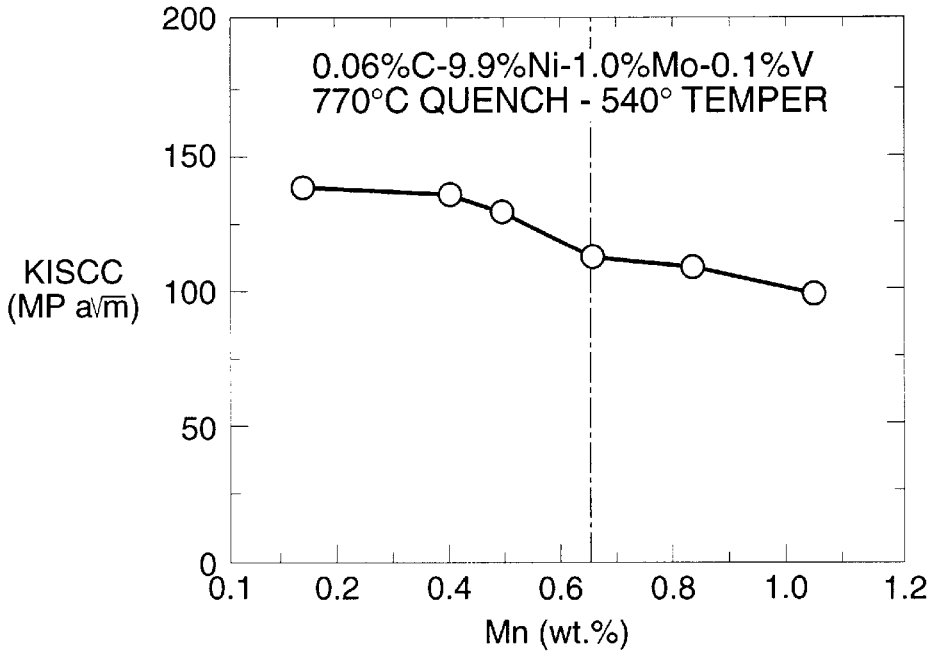
FIG. 1 is a diagram showing the relationship between the Mn content and the stress corrosion cracking resistance of a steel product.
Figure 1B:
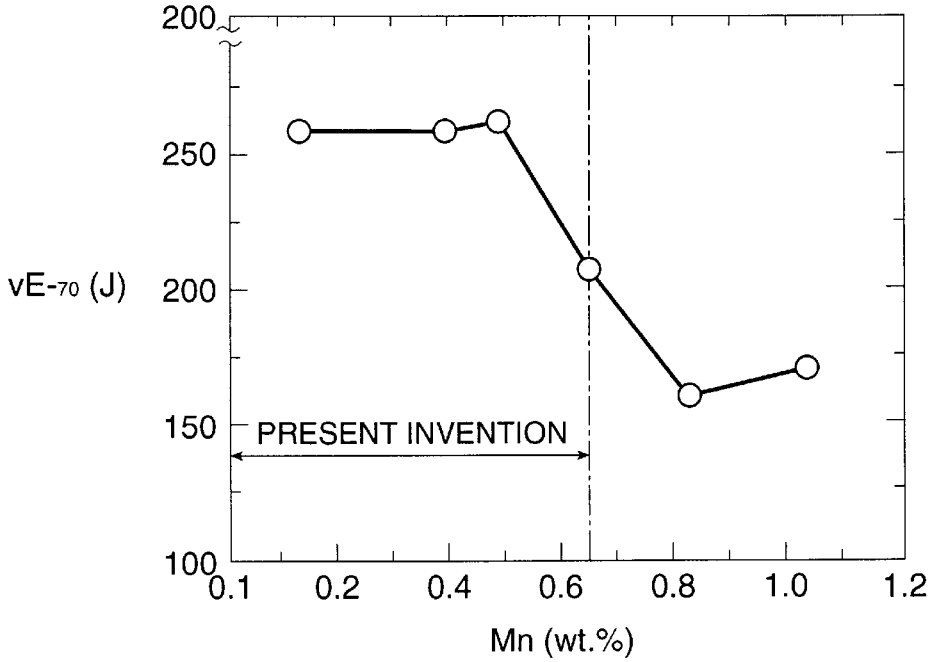

Mn is necessary for improving the quenchability and not workability. However, when the Mn content is less than 0.05%, the improvement effect cannot be attained. On the other hand, in the case of the Ni-containing steel contemplated in the present invention, the addition of Mn increases the susceptibility to temper brittleness and deteriorates the stress corrosion cracking resistance of the welding-heat affected zone, so that the Mn content should be 0.65% or less. FIG. 1 shows the toughness and the results of a stress corrosion cracking test ($K_{1SCC}$ test) in artificial sea water for steel plates produced by subjecting a slab having a composition of 0.6%C−9.9% Ni−1.0% Mo−0.01% V with the amount of addition of Mn being varied from 0.15 to 1.05% to hot rolling and air cooling, reheating the cooled plate to 770° C. quenching the reheated plate and tempering the quenched plate at 540° C. It is apparent that the low-temperature toughness and the stress corrosion cracking resistance are improved with lowering the Mn content. For this reason, the Mn content is limited to 0.05 to 0.65%.

Ni is useful for enhancing the stacking fault energy, increasing the cross slip, facilitating the occurrence of stress relaxation, increasing the impact absorption energy and improving the low-temperature toughness.

Further, Ni exhibits the best effect when it is present together with Mo, V and other elements contained in the steel of the present invention. Specifically, when the steel is reheated to a temperature region of from ($A_{C3}$ point−40° C.) to ($A_{C3}$ point+40° C.), a grain mixture of diffusion type reverse transformed γ grains comprising a massive austenite formed by dissolution of carbides with non-diffusion type reverse transformed γ grains comprising a group of acicular austenities not involving the dissolution of carbides is formed, and the non-diffusion type reverse transformed γ grains have a higher dislocation density than the diffusion type reverse transformed γ grains and very effectively contributes to an increase in the strength. Specifically, Ni serves to delay the dissolution of carbides of Mo, V and other elements, which enables the group of acicular austenities to be stably maintained up to a high temperature. For this reason, Ni should be added in an amount of 8.0% or more for the purpose or ensuring the strength by taking advantage of stabilization of the non-diffusion type reverse transformed γ grains at a high temperature. On the other hand, when the amount of addition of Ni exceeds 11.0% austenite is precipitated during tempering, which deteriorates the strength and toughness. For this reason, the Ni content is limited to 8.0 to 11.0%.

Mc is an element useful for the precipitation hardening by tempering and the inhibition of temper brittleness and, at the same time, important to the present invention as with Ni. Specifically, since a fine carbide composed mainly of Mo precipitated in the course of heating in the step of reheating and quenching remains as an undissolved carbide up to a high temperature, the group of acicular austenites having a high dislocation density can be maintained at a high temperature, so that Mo is necessary for ensuring the strength. However, when the Mo content is less than 0.5%, the dissolution of the Mo carbide occurs in the reheating and quenching, which causes the non-diffusion type transformed γ grains to be rapidly attacked by the diffusion type reverse transformed γ grains, so that a contemplated strength cannot be obtained. On the other hand, when the Mo content exceeds 1.5%, the effect of improving the strength is saturated, so that the amount of coarse alloy carbides is increased to lower the toughness. For this reason, the Mo content is limited to 0.5 to 1.5%.

Cr serves to improve the quenchability and is useful for ensuring the strength. The Cr content content should be 0.2% at the lowest. When it exceeds 1.5%, the increase in the strength is saturated and the toughness is lowered. For this reason, the Cr content is limited to 0.2 to 1.5%.

V is useful for forming a carbonitride in the tempering that is precipitation-hardened to ensure the strength. Further, as with Mo, V is finely precipitated during heating in the reheating and quenching to increase the stability of non-diffusion type reverse transformed γ grains comprising a group of acicular austenites, which is useful for ensuring the strength. When the V content is less than 0.02%, no contemplated strength cannot be attained, while when it exceeds 0.20%, the toughness is lowered. For this reason, the V content is limited to 0.02 to 0.20%.

Al is necessary for deoxidation and, at the same time, combines with N to form a nitride, AlN, that has the effect of refining the structure. However, when the Al content is less than 0.01%, this effect is small. On the other hand, when it exceeds 0.08%, the amount of inclusions comprising alumina becomes so large that the toughness is inhibited. For this reason, the Al content is limited to 0.01 to 0.08%.

In the present invention, at least one member selected from (Cu, Nb, Ti and (Ca, REM) is added besides the above-described ingredients. Cu, No and Ti exhibit an equalizing action, that is, serve to improve the strength of the steel. Further, Nb and Ti are useful also for the refinement of austenite grains. In order to ensure a desired effect, it is necessary for the lower limits of Cu, Nb and Ti to be 0.2%, 0.005% and 0.005%, respectively. However, when the Cu, Nb and Ti contents exceed 1.5%, 0.10% and 0.03%, respectively, not only the low-temperature toughness is lowered but also the susceptibility to stress corrosion cracking is enhanced. For this reason, the Cu, Nb and Ti contents are limited to the above-described respective ranges.

Ca and REM (Rare earth metal) have the effect of spheroidizing nonmetallic inclusions and are useful for improving both the toughness and anisotropy. For this purpose, the Ca and REM should be present in an amount of 0.00005% at the smallest. However, when the Ca and REM contents exceed 0.005% and 0.0100%, respectively, the toughness is lowered due to an increase in the amount of inclusions. For this reason, the Ca and REM contents are limited to 0.0005 to 0.005% and 0.0005 to 0.0100%, respectively.

The steel of the present invention contains, besides the above-described ingredients, P, S, N, O and other elements as unavoidable impurities that are detrimental to the toughness and stress corrosion cracking resistance characteristic of the steel of the present invention and, therefore, the amount of these unavoidable impurities is as small as possible. The contents of P, S, N and O are preferably regulated to 0.005% or less, 0.003% or less, 0.0050% and 0.0030%, respectively.

The production process which is another subject matter of the present invention will now be described.

Even when the steel comprises the above-described composition, the production process should be proper for attaining the strength, toughness and stress corrosion cracking resistance contemplated in the present invention. Accordingly, in the process of the present invention, the rolling, cooling and reheating-quenching tempering conditions were limited for the following reasons.

At the outset, a slab comprising the above-described ingredients is heated to 1000° to 1250° C. In the heating, in order to attain, besides the refinement of heated austenite grains, utilization of the strengthening by taking advantage of the above-described non-diffusion type reverse transformed γ and fine precipitation in the reheating-quenching-tempering after the hot rolling, the slab should be heated to 1000° C. or above to sufficiently dissolve Mo, Cr, V, Nb, etc., in a solid solution form. In this case, when the temperature is below 1000° C., the dissolution of these elements in a solid solution form is unsatisfactory and the alloy carbide ($M_6C$) remaining undissolved is coarsened, which makes it impossible to expect sufficient precipitation hardening in the tempering and, at the same time, is causative of a lowering in the toughness. On the other hand, when the temperature exceeds 1250° C., although alloy carbides of Mo, Cr, V, Nb, etc., are sufficiently dissolved in a solid solution form, in the Ni-containing steel contemplated in the present invention, the amount of the oxide on the surface of the slab is increased, which finally results in the occurrence of a surface flaw after the rolling. Further, heated austenite grains are coarsened, and it becomes difficult to refine the austenite grains in the subsequent rolling, which is causative of a lowering in the toughness. For these reasons, the heating temperature of the salt is limited to 1000° to 1250° C.

The heated slab is then hot-rolled at a temperature of the Ar' transformation point and air-cooled. In the steel of the present invention, since the Ar' point is as low as 400° C., the above requirement can be met by simply subjecting the heated slab to conventional hot rolling. Further, since the steel of the present invention has a composition having a sufficiently high quenchability, air cooling alone suffices for the formation of a martensitic single phase structure including a sufficiently large amount of dislocation. It is noted that, since non-diffusion type reverse transformed γ grains contributing to strengthening are the same as the γ grains after the hot rolling, if it is necessary to ensure a higher low-temperature toughness, although a lowering in the roll finishing temperature is preferred according to need for the purpose of refining the γ grains by rolling-recrystallization, there is not limitation on the method.

The steel plate after hot rolling and air cooling is then reheated to a temperature range of from ($A_{C3}$ point−40° C.) to ($A_{C3}$ point+40 ° C.) and quenched. In the step of heat treatment, wherein reheating is effected with the martensite structure used as a precursor structure, when the steel is heated to an α−γ dual phase coexisting temperature region, diffusion type reverse transformed γ grains comprising an ordinary massive austenite are formed from old austenite grain boundaries while a group of acicular austenites are formed from the intragranular martensite. They coexist together with carbides and ferrite. Since the acicular austenite is produced by non-diffusion type (martensitic) reverse transformation, it has a large amount of dislocation that contributes to an increase in the strength. Further, the heating of the steel plate to a temperature range of from ($A_{C3}$ point−40° C.) to ($A_{C3}$ point+40° C.) causes the group of acicular austenites to increase their area to form non-diffusion type reverse transformed γ grains that are stably maintained up to a high temperature and become fine austenite grains comprising a mixture thereof with diffusion type reverse transformed γ grains. When quenching is effected from this temperature region, a martensitic structure, into which further dislocating has been introduced, is formed, so that it becomes possible to produce an extra high tensile steel.

Figure 3C:
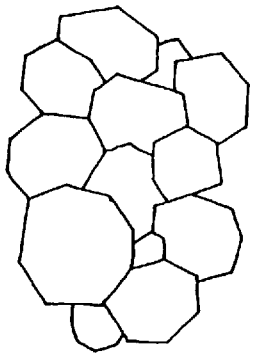
FIG. 3 is a schematic view of a metallic microstructure in connection with a reheating temperature region, wherein (A)
Figure 3B:
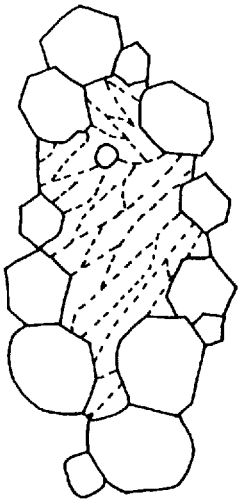
Figure 3A:
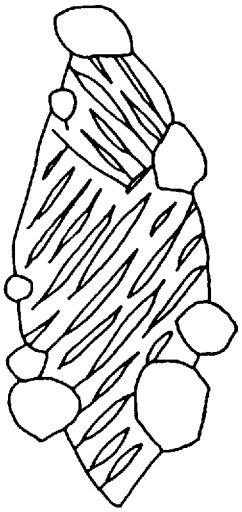

When the steel plate is heated to a temperature of ($A_{C3}$ point+40° C.), the non-diffusion type reverse transformed γ grains contributing to strengthening after quenching are converted to ordinary diffusion type reverse transformed γ grains, which gives rise to a lowering in the strength of the steel plate. Therefore, the reheating temperature for quenching should be in the range of from ($A_{C3}$ point−40° C.) to ($A_{C3}$ point+40° C.) and is preferably $A_{C3}$ point ±20° C. from the viewpoint of stabilizing the non-diffusion type reverse transformed γ grains. The above-described change in the austenite grains (γ grains) is shown in FIG. 3. FIG. 3(B) is a schematic view of a grain mixture of non-diffusion type reverse transformed γ grains with diffusion type reverse transformed γ grains, which grain mixture has been formed by a treatment in reheating temperature region for quenching of from ($A_{C3}$ point−40° C.) to ($A_{C3}$ point+40° C.) specified in the present invention. FIG. 3(A) is a diagram showing the results for a reheating temperature region of ($A_{C3}$ point−40° C.) or below, and FIG. 3(C) is a diagram showing the results for a reheating temperature region of ($A_{C3}$ point+40 ° C.) or above.

Figure 2:
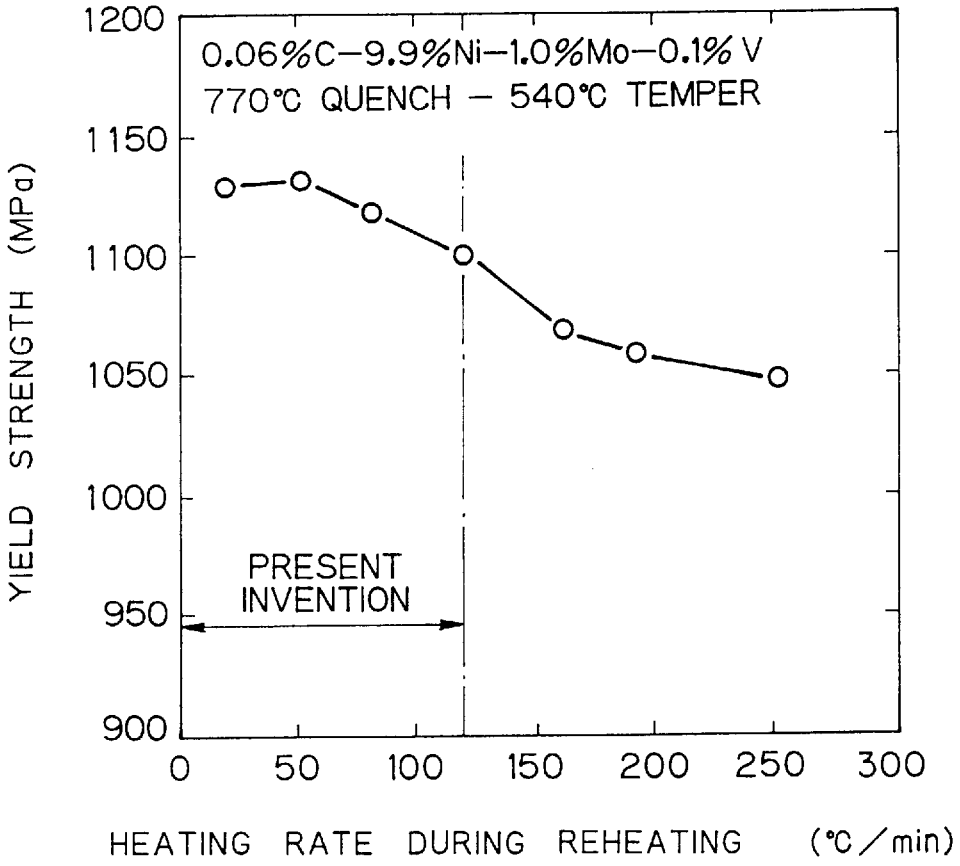
FIG. 2 is a diagram showing the relationship between the temperature rise rate during reheating and the yield strength.

A temperature rise rate of 120° C./min or less during the reheating is also one of the characteristic features of the present invention. FIG. 2 shows the results of a yield strength test on a steel plate produced by subjecting a slab having a composition of 0.06% C–9.9% Ni–1.0% Mo–0.1% V to heating at 1150° C., rolling and air cooling, reheating the steel plate to 790° C. with varied temperature rise rate, quenching the steel plate and temperature the quenched steel plate at 540° C. It is apparent that the strength is improved with lowering the temperature rise rate. It is reported that the non-diffusion type reverse transformed γ is generally formed by rapid heating. However, it has been found that, the steel having a high Ni content according to the present invention, the non-diffusion type reverse transformed γ is formed without rapid heating and, as opposed to the conventional common knowledge, a temperature rise rate of 120° C./min or less is advantageous from the viewpoint of increasing the strength. Detailed studies on this point have revealed that carbides are nitrides of Mo, Cr, V, Nb, etc., precipitated during gradual heating increase the stability of the once formed non-diffusion type reverse transformed γ, so that the area ration of the non-diffusion type reverse transformed γ grains contributing to strengthening is increased.

The steel plate after the reheating and quenching is then tempered at a temperature of an $Ac_1$ point or below, in this case, when the temperature exceeds the $Ac_1$ point, the strength and toughness are lowered due to the formation of unstable austenite. For this reason, the temperating temperature is limited to $Ac_1$ point or below for the purpose of sufficiently precipitation strengthening through fine precipitation of Mo, Cr, V, Nb, etc., to provide a high strength and a high toughness.

The steel provided by the above-described production process has a high strength and a high toughness despite a low carbon content and an remarkably improved stress corrosion cracking resistance, particularly at the welding-heat affected zone.

EXAMPLES

Steels having compositions specified in Table 1 were produced by the melt process to provide slabs that were then used to produce steel plates having a thickness of 20 to 80 mm under production conditions according to the process of the present invention or comparative process specified in Table 2.

The mechanical properties of these base materials and the $K_{1SCC}$ value (limiting fracture toughness value relative to stress corrosion cracking resistance) of the base material portion and welding-heat affected zone were examined. The welding was effected at a heat input or 25 kJ/cm by TIG welding.

The mechanical properties of base materials produced by using plates having chemical compositions specified in Table 1 and production conditions specified in Table 2 and the results of $K_{1SCC}$ test for the base material portion and welding-heat affected zone using test pieces specified in ASTM E 399 in artificial sea water of 3.5% NaCl are given in Table 3. In the evaluation method, a precracked test piece was used under a service environmental condition (in this case, sea water), and the tip of the notch is brought to a severe condition (stress load) to facilitate the occurrence of a delayed fracture. The stress corrosion cracking resistance is evaluated by effecting a constant load test under this environment at a K value (a coefficient of stress necessary for preventing the occurrence of cracking at the tip of the notch) on various levels to determine a limit of $K_{1SCC}$ value that does not cause a fracture at a certain K value or less. With respect to the evaluation of the $K_{1SCC}$ property of the welding-heat affected zone, a notch is provided at the center of HAZ as shown in FIG. 5.

In the table, the thick underlined portion is outside the scope of the present invention and unsatisfactory in the properties thereof.

TABLE 1

| | (wt. %) | | | | | | | | | | | | | | | | | |
|---|---|---|---|---|---|---|---|---|---|---|---|---|---|---|---|---|---|---|
| Steel | C | Si | Mn | Ni | Mo | Cr | V | Al | Cu | Nb | Ti | Ca | REM | P | S | N | O | $Ac_3$ (°C.) |
| Steel of Invention | | | | | | | | | | | | | | | | | | |
| A | 0.06 | 0.08 | 0.58 | 8.7 | 1.05 | 0.76 | 0.06 | 0.036 | — | — | — | — | — | 0.004 | 0.001 | 0.0032 | 0.0020 | 773 |
| B | 0.07 | 0.02 | 0.60 | 8.5 | 1.54 | 0.39 | 0.09 | 0.075 | — | — | — | — | — | 0.002 | 0.002 | 0.0018 | 0.0015 | 785 |
| C | 0.07 | 0.06 | 0.38 | 9.3 | 0.63 | 0.85 | 0.14 | 0.028 | — | — | — | — | — | 0.004 | 0.001 | 0.0045 | 0.0023 | 792 |
| D | 0.06 | 0.04 | 0.55 | 9.7 | 1.20 | 0.55 | 0.10 | 0.032 | — | — | — | — | — | 0.003 | 0.002 | 0.0030 | 0.0018 | 785 |
| E | 0.04 | 0.05 | 0.40 | 9.8 | 1.02 | 1.47 | 0.06 | 0.036 | — | — | — | — | — | 0.004 | 0.002 | 0.0045 | 0.0026 | 776 |
| F | 0.05 | 0.03 | 0.25 | 9.9 | 1.01 | 0.78 | 0.12 | 0.032 | — | — | — | — | — | 0.001 | 0.001 | 0.0022 | 0.0025 | 760 |
| G | 0.05 | 0.02 | 0.05 | 10.2 | 1.29 | 0.87 | 0.11 | 0.021 | — | — | — | 0.0024 | — | 0.001 | 0.001 | 0.0046 | 0.0018 | 768 |
| H | 0.04 | 0.01 | 0.54 | 8.4 | 1.25 | 0.45 | 0.09 | 0.032 | 1.20 | — | — | — | — | 0.003 | 0.001 | 0.0025 | 0.0012 | 784 |
| I | 0.05 | 0.07 | 0.43 | 9.5 | 0.73 | 1.15 | 0.10 | 0.025 | 0.35 | — | 0.008 | — | 0.0052 | 0.003 | 0.003 | 0.0035 | 0.0022 | 770 |
| J | 0.09 | 0.01 | 0.03 | 10.8 | 1.03 | 0.51 | 0.09 | 0.036 | 0.25 | 0.04 | — | — | — | 0.003 | 0.002 | 0.0024 | 0.0014 | 761 |
| K | 0.08 | 0.05 | 0.11 | 9.6 | 0.99 | 0.64 | 0.03 | 0.028 | — | 0.11 | — | — | 0.0041 | 0.002 | 0.001 | 0.0035 | 0.0015 | 755 |
| L | 0.07 | 0.02 | 0.24 | 9.9 | 0.64 | 0.99 | 0.11 | 0.024 | — | 0.02 | — | — | — | 0.001 | 0.001 | 0.0033 | 0.0023 | 780 |
| M | 0.06 | 0.06 | 0.52 | 9.8 | 0.95 | 0.57 | 0.06 | 0.067 | — | 0.01 | — | 0.0035 | — | 0.003 | 0.003 | 0.0024 | 0.0021 | 796 |
| N | 0.05 | 0.04 | 0.61 | 9.5 | 1.28 | 0.43 | 0.03 | 0.041 | — | 0.04 | — | — | — | 0.002 | 0.002 | 0.0027 | 0.0018 | 785 |
| O | 0.08 | 0.07 | 0.46 | 10.1 | 1.33 | 0.56 | 0.05 | 0.018 | — | — | 0.015 | — | — | 0.002 | 0.003 | 0.0040 | 0.0025 | 758 |
| Comp. Steel | | | | | | | | | | | | | | | | | | |
| P | 0.06 | 0.07 | 0.47 | 8.2 | 0.12 | 0.95 | 0.12 | 0.026 | — | — | — | — | — | 0.003 | 0.002 | 0.0042 | 0.0023 | 786 |
| Q | 0.07 | 0.01 | 0.13 | 9.7 | 0.82 | 0.43 | 0.01 | 0.033 | — | — | — | — | — | 0.002 | 0.002 | 0.0019 | 0.0038 | 776 |

TABLE 1-continued

| Steel | C | Si | Mn | Ni | Mo | Cr | V | Al | Cu | Nb | Ti | Ca | REM | P | S | N | O | $Ac_3$ (°C.) |
|---|---|---|---|---|---|---|---|---|---|---|---|---|---|---|---|---|---|---|
| | (wt. %) | | | | | | | | | | | | | | | | | |
| R | 0.07 | 0.09 | 0.53 | 4.5 | 1.25 | 0.47 | 0.09 | 0.036 | — | — | — | — | — | 0.003 | 0.001 | 0.0035 | 0.0026 | 814 |
| S | 0.09 | 0.08 | 0.78 | 10.3 | 1.04 | 0.86 | 0.11 | 0.028 | — | 0.02 | — | — | — | 0.001 | 0.002 | 0.0027 | 0.0018 | 756 |
| T | 0.11 | 0.05 | 0.82 | 9.4 | 1.21 | 0.52 | 0.10 | 0.045 | — | — | — | — | — | 0.002 | 0.001 | 0.0028 | 0.0021 | 764 |
| U | 0.11 | 0.02 | 0.52 | 11.4 | 0.86 | 0.78 | 0.04 | 0.029 | — | 0.04 | — | — | — | 0.005 | 0.001 | 0.0027 | 0.0019 | 760 |
| V | 0.12 | 0.09 | 0.28 | 9.7 | 1.22 | 0.76 | 0.09 | 0.034 | — | 0.03 | — | — | 0.0051 | 0.001 | 0.001 | 0.0036 | 0.0025 | 769 |

Note) $Ac_3$ transformation point was measured with a Formaster thermal expansion transformation measuring apparatus.

TABLE 2

| Production Condition No. | Heating-Rolling Conditions: Slab Heating Temp. (°C.) | Heating-Rolling Conditions: Roll Finishing Temp. (°C.) | Reheating and Quenching Conditions: Heating Rate (°C./min) | Reheating and Quenching Conditions: Reheating Temp. for Quenching (°C.) | Tempering: Condition Tempering Temp. (°C.) |
|---|---|---|---|---|---|
| Invention | | | | | |
| 1 | 1100 | 815 | 35 | 790 | 550 |
| 2 | 1050 | 900 | 35 | 800 | 560 |
| 3 | 1230 | 950 | 80 | 775 | 550 |
| 4 | 1100 | 800 | 50 | 790 | 540 |
| 5 | 1050 | 835 | 10 | 765 | 540 |
| 6 | 1180 | 850 | 102 | 770 | 560 |
| 7 | 1200 | 800 | 78 | 780 | 540 |
| 8 | 1150 | 820 | 45 | 785 | 560 |
| 9 | 1150 | 810 | 30 | 780 | 550 |
| 10 | 1180 | 850 | 102 | 770 | 560 |
| 11 | 1150 | 900 | 42 | 765 | 550 |
| 12 | 1170 | 950 | 30 | 790 | 500 |
| 13 | 1200 | 835 | 15 | 775 | 560 |
| 14 | 1050 | 825 | 10 | 790 | 540 |
| 15 | 1000 | 870 | 8 | 760 | 560 |

TABLE 2-continued

| Production Condition No. | Heating-Rolling Conditions: Slab Heating Temp. (°C.) | Heating-Rolling Conditions: Roll Finishing Temp. (°C.) | Reheating and Quenching Conditions: Heating Rate (°C./min) | Reheating and Quenching Conditions: Reheating Temp. for Quenching (°C.) | Tempering: Condition Tempering Temp. (°C.) |
|---|---|---|---|---|---|
| Comparative | | | | | |
| 16 | 1100 | 840 | 32 | 775 | 560 |
| 17 | 1200 | 800 | 78 | 780 | 540 |
| 18 | 1150 | 825 | 25 | 820 | 590 |
| 19 | 1150 | 900 | 42 | 765 | 550 |
| 20 | 1100 | 805 | 32 | 790 | 580 |
| 21 | 1180 | 850 | 102 | 770 | 560 |
| 22 | 1200 | 800 | 78 | 780 | 540 |
| 23 | 1100 | 815 | 190 | 790 | 540 |
| 24 | 1150 | 835 | 50 | 700 | 560 |
| 25 | 900 | 780 | 15 | 790 | 560 |
| 26 | 1050 | 825 | 26 | 840 | 560 |
| 27 | 950 | 760 | 108 | 780 | 540 |
| 28 | 1170 | 800 | 252 | 770 | 550 |
| 29 | 1180 | 950 | 42 | 830 | 540 |

TABLE 3

| Production Condition No. | Steel | Plate Thickness (mm) | Tensile Test: Yield Strength (MPa) | Tensile Test: Tensile Strength (MPa) | Tensile Test: Elongation (%) | Impact Test: vTrs (°C.) | Impact Test: vE-70° C. (J) | Limit of $K_{ISCC}$ of Base Material (MPa$\sqrt{m}$) | Limit of $K_{ISCC}$ of Welding Heat Affected Zone (MPa$\sqrt{m}$) |
|---|---|---|---|---|---|---|---|---|---|
| Ex. of Invention | | | | | | | | | |
| 1 | A | 40 | 1103 | 1204 | 24 | −150 | 223 | 155 | 149 |
| 2 | B | 40 | 1113 | 1205 | 22 | −170 | 233 | 167 | 146 |
| 3 | C | 20 | 1121 | 1211 | 22 | −160 | 221 | 164 | 146 |
| 4 | D | 40 | 1126 | 1214 | 22 | −170 | 241 | 186 | 158 |
| 5 | E | 50 | 1116 | 1228 | 23 | −160 | 236 | 167 | 158 |
| 6 | F | 40 | 1106 | 1240 | 23 | −170 | 250 | 177 | 130 |
| 7 | G | 40 | 1098 | 1238 | 22 | −180 | 276 | 164 | 136 |
| 8 | H | 40 | 1126 | 1195 | 24 | −150 | 230 | 174 | 154 |
| 9 | I | 20 | 1137 | 1265 | 22 | −150 | 233 | 164 | 155 |
| 10 | J | 40 | 1140 | 1284 | 23 | −160 | 224 | 161 | 127 |
| 11 | K | 40 | 1120 | 1270 | 22 | −150 | 210 | 186 | 126 |
| 12 | L | 40 | 1114 | 1243 | 23 | −160 | 263 | 155 | 130 |
| 13 | M | 60 | 1125 | 1210 | 22 | −170 | 239 | 167 | 149 |
| 14 | N | 50 | 1110 | 1192 | 24 | −170 | 248 | 186 | 151 |
| 15 | O | 80 | 1126 | 1256 | 22 | −160 | 285 | 161 | 146 |
| Comp. Ex. | | | | | | | | | |
| 16 | P | 40 | 979 | 1098 | 24 | −130 | 227 | 161 | 136 |
| 17 | Q | 40 | 950 | 1111 | 22 | −140 | 256 | 161 | 136 |

TABLE 3-continued

| Production Condition No. | Steel | Plate Thickness (mm) | Tensile Test: Yield Strength (MPa) | Tensile Test: Tensile Strength (MPa) | Tensile Test: Elongation (%) | Impact Test: vTrs (°C.) | Impact Test: vE-70° C. (J) | Limit of $K_{1SCC}$ of Base Material (MPa$\sqrt{m}$) | Limit of $K_{1SCC}$ of Welding Heat Affected Zone (MPa$\sqrt{m}$) |
|---|---|---|---|---|---|---|---|---|---|
| 18 | R | 40 | 847 | 936 | 23 | −130 | 217 | 177 | 130 |
| 19 | S | 40 | 1120 | 1231 | 22 | −120 | 160 | 135 | 109 |
| 20 | T | 40 | 1127 | 1230 | 23 | −130 | 155 | 111 | 90 |
| 21 | U | 40 | 1125 | 1240 | 23 | −110 | 118 | 150 | 112 |
| 22 | V | 40 | 1140 | 1232 | 22 | −150 | 219 | 142 | 99 |
| 23 | D | 40 | 1038 | 1147 | 23 | −140 | 212 | 150 | 158 |
| 24 | D | 40 | 994 | 1125 | 22 | −120 | 140 | 164 | 158 |
| 25 | B | 40 | 1051 | 1133 | 24 | −120 | 142 | 146 | 146 |
| 26 | B | 40 | 1024 | 1153 | 22 | −150 | 214 | 127 | 146 |
| 27 | F | 40 | 1065 | 1137 | 23 | −180 | 172 | 136 | 130 |
| 28 | J | 40 | 1047 | 1108 | 24 | −160 | 223 | 142 | 126 |
| 29 | L | 40 | 981 | 1154 | 22 | −150 | 206 | 136 | 130 |

Note) A $K_{1SCC}$ test piece for the base material was sampled from ½t portion of plate thickness and notched in the C direction. On the other hand, a test piece for the welding-heat affected zone was notched at the center of the welding heat affected zone. These test pieces were tested in 3.5% NaCl artificial sea water.

In the examples of the present invention (1—A to 15-0 wherein steels failing within the scope of the present invention is used in combination with the process of the present invention), the base materials had good mechanical properties, i.e., a high strength and a high toughness, and with respect to the stress corrosion cracking resistance as well, both the base material and welding heat affected zone had a sufficiently high $K_{1SCC}$ value.

On the other hand, with respect to comparative examples wherein the process falling within the scope of the present invention is used in combination with comparative steels (P to V) outside the chemical composition range specified in the present invention, in 16-P and 17-Q, since the Mo and V content are low, non-diffusion type reverse transformed γ grains are not formed and the precipitation strengthening is also small, so that the strength is unsatisfactory. In 18-R, since the Ni content is low, non-diffusion type reverse transformed γ grains are not formed, so that the strength is unsatisfactory. In 19-S and 20-T, since the Mn content and both C and Mn contents are high, the toughness and the $K_{1SCC}$ value of the base material and the welding heat affected zone are low. In 21-U, since the C and Ni contents are high, the $K_{1SCC}$ value of the base material and the welding-heat affected zone are low. In 22-V, since the C content is high, the $K_{1SCC}$ value of the welding-heat affected zone is low.

With respect to comparative examples wherein steels falling within the scope of the present invention are used in combination with comparative processes (23 to 29) outside the scope of the present invention, in 23-D and 28-J, since the temperature rise rate in the reheating for quenching is high, the non-diffusion type reverse transformed γ grains become unstable, which increases the amount of the diffusion type reverse transformed γ grains, so that the strength becomes unstable. In 24-D, since the reheating temperature for quenching is so low that a large amount of ferrite is present between the group of acicular γ grains, which gives rise to a lowering in the strength and toughness. In 25-B and 27-F, since the slab heating temperature is so low that not only coarse undissolved precipitates or carbides are present but also the precipitation strengthening is small, so that the strength and toughness are unsatisfactory. In 26-B and 29-L, since the reheating temperature for quenching is high, the diffusion type reverse transformed γ grains are formed, so that the strength is unsatisfactory. Further, in this case, the $K_{1SCC}$ value of the base material is somewhat lowered. FIG. 4 is a graph showing the $K_{1SCC}$ values of the steel of the present invention, comparative steel and conventional materials. From this drawing, it is apparent that the $K_{1SCC}$ value of the steel of the present invention is on a level significantly improved over those of the conventional materials.

As described above, the composition range and process according to the present invention have enabled an extra high tensile steel having a yield strength of 1080 MPa or more and excellent in low-temperature toughness and stress corrosion cracking resistance at the welding-heat affected zone to be stably produced and supplied, so that it has become possible to significantly improve the reliability of containers and equipment used in a deep-sea environment.

We claim:

1. A process for producing an extra high tensile steel having an excellent stress corrosion cracking resistance, comprises the steps of: heating a slab consisting essentially of, in terms of % by weight, 0.04 to 0.09% of C, 0.01 to 0.10% of Si, 0.05 to 0.65% of Mn, more than 8.0 and up to 11.0% of Ni, 0.5 to 1.5% of Mo, 0.2 to 1.5% of Cr, 0.02 to 0.20% of V and 0.01% to 0.08% of Al with the balance consisting of iron and unavoidable impurities, to a temperature between 1000° C. and 1250° C., conventionally hot-rolling the slab at a temperature of Ar' point or above to form a hot-rolled plate, after hot-rolling, air-cooling the hot-rolled plate to a temperature below ($A_{C3}$ point−40° C.) thereby providing a cooled-rolled plate, after air-cooling, as a subsequent heating process, reheating the cooled-rolled plate at a rate of 120° C./min or less to a temperature region of from ($A_{C3}$ point−40° C.) to less than $A_{C3}$ point, quenching the reheated plate and subsequently tempering the quenched plate at a temperature of the $A_{C1}$ point or below, thereby providing extra high tensile steel having a yield strength of at least 1080 MPa and a limit of $K_{1SCC}$ of base material of at least 155 MPa$\sqrt{m}$.

2. A process for producing an extra high tensile steel having an excellent stress corrosion cracking resistance, comprises the steps of: heating a slab consisting essentially of, in terms of % by weight, 0.04 to 0.09% of C, 0.01 to 0.10% of Si, 0.05 to 0.65% of Mn, more than 8.0 and up to 11.0% of Ni, 0.5 to 1.5% of Mo, 0.2 to 1.5% of Cr, 0.02 to 0.20% of V and 0.01% to 0.08% of Al and further comprising at least one member selected from the group consisting of 0.2 to 1.5% Cu, 0.005 to 0.10% of Nb and 0.005 to 0.03% of Ti as strength improving elements and 0.0005 to 0.0005% of Ca and 0.0005 to 0.0100% of REM as elements for regulating inclusions with the balance consisting of iron and unavoidable impurities, to a temperature between 1000° C. and 1250° C., conventionally hot-rolling the slab at a temperature of Ar' point or above to form a hot-rolled plate, after hot-rolling, air-cooling the hot-rolled plate to a temperature below ($A_{C3}$ point−40° C.) thereby providing a cooled-rolled plate, after air-cooling, as a subsequent heating process, reheating the cooled-rolled plate at a rate of 120° C./min or less to a temperature region of from ($A_{C3}$ point−40° C.) to less than $A_{C3}$ point, quenching the reheating plate and subsequently tempering the quenched plate at a temperature of the $A_{C1}$ point or below, thereby providing extra high tensile steel having a yield strength of at least 1080 MPa and a limit of $K_{1SCC}$ of base material of at least 155 MPa$\sqrt{m}$.

* * * * *

UNITED STATES PATENT AND TRADEMARK OFFICE

CERTIFICATE OF CORRECTION

PATENT NO. : 5,827,379

DATED : October 27, 1998

INVENTOR(S) : Yoshihiro OKAMURA, et al.

It is certified that error appears in the above-indentified patent and that said Letters Patent is hereby corrected as shown below:

Column 1, line 45, change "race" to --rate--.

Column 2, line 14, change "if" to --is--.

Column 3, line 26, change "not" to --hot--.

Column 3, line 52, change "then" to --when--.

Column 3, line 56, change "not" to --hot--.

Column 4, line 37, change "Mc" to --Mo--.

Column 7, line 24, change "are" to --and--.

Column 7, line 27, change "ration" to --ratio--.

Column 7, line 30, change "below, in this" to --below. In this--.

Column 12, line 40, after "steel" insert -- in 1080MPa yield strength class .--.

Signed and Sealed this

Eleventh Day of April, 2000

*Attest:*

*Attesting Officer*

Q. TODD DICKINSON

*Director of Patents and Trademarks*